United States Patent [19]

Raab et al.

[11] Patent Number: 4,814,775

[45] Date of Patent: Mar. 21, 1989

[54] RECONFIGURABLE BEAM-FORMING NETWORK THAT PROVIDES IN-PHASE POWER TO EACH REGION

[75] Inventors: Anthony R. Raab, Waterloo; Henry Downs, Kitchener, both of Canada

[73] Assignee: COM DEV Ltd., Cambridge, Canada

[21] Appl. No.: 25,271

[22] Filed: Mar. 12, 1987

[30] Foreign Application Priority Data

Sep. 26, 1986 [CA] Canada ..... 519130

[51] Int. Cl.[4] ..... H01Q 3/22; H01Q 3/24; H01Q 3/26

[52] U.S. Cl. ..... 342/373; 342/368; 342/374

[58] Field of Search ..... 342/372, 373, 374, 368

[56] References Cited

U.S. PATENT DOCUMENTS

| | | | |
|---|---|---|---|
| 4,228,436 | 10/1980 | du Fort | 343/854 |
| 4,499,471 | 2/1985 | Luh | 342/373 |
| 4,612,548 | 9/1986 | Beltran | 342/373 |
| 4,692,768 | 9/1987 | Becavin | 342/368 |

*Primary Examiner*—Theodore M. Blum

*Attorney, Agent, or Firm*—Daryl W. Schnurr

[57] ABSTRACT

A reconfigurable beam-forming network for use with a transmitter has a waveguide R-switch that is interconnected with a Magic T. The R-switch contains phasing elements and is connected to a dual-mode power-dividing network, which in turn is connected to first, second and third region power-dividing networks, each having their own feed horn array. The R-switch can be moved to three different positions so that in a first position power is divided between two input ports of the dual-mode network on substantially a fifty-fifty basis with the power on the two input ports being out of phase on a positive basis. In a second position of the R-switch, power is also divided on substantially a fifty-fifty basis between the two input ports but the power is out of phase between the two ports on a negative basis. In a third position of the R-switch, substantially all of the power entering the R-switch is passed into the first input port of the dual-mode network. The power being fed to the feed horns of any one of the regions has the same phase. In a variation of the invention, the R-switch and Magic T are replaced by a variable phase shifter and Magic T.

14 Claims, 11 Drawing Sheets

PRIOR ART

PRIOR ART

RECONFIGURABLE BEAM-FORMING NETWORK THAT PROVIDES IN-PHASE POWER TO EACH REGION

BACKGROUND OF THE INVENTION

1. Field of the Invention

This invention relates to a reconfigurable beam-forming network to which a transmitter may be connected and, in particular, relates to a reconfigurable beam-forming network in which a plurality of distinct beams can be formed with power being fed to a plurality of regions being in-phase.

2. Description of the Prior Art

It is known to have reconfigurable beam-forming networks in which the shape of the beam can be varied. It is important, when the beam is varied, that no areas of the footprint are provided with less than satisfactory flux coverage and that the available flux can be concentrated, usually in a weighted manner within the footprint.

For example, in order to generate by means of a beam-forming network, a beam which covers the western half of Canada, a common approach is to use an array of electro-magnetic horns located in the focal plane of a parabolic reflector. In considering the antenna as a transmitting antenna, it is necessary to provide a control portion of the output of the transmitting source to each of the horns. This process, which provides the required weighting in amplitude and phase to each horn is referred to as beam-forming and is carried out by a beam-forming network. Usually, it is also necessary to provide coverage of the eastern half of Canada by means of a separate horn array and separate beam-forming network. Unfortunately, the region of Canada where the two half-Canada footprints touch, namely along the north-south dividing line of the West and East Canada beams, is subjected to low flux and special means must be taken to overcome these limitations. One known means employs dual-mode techniques which rely on the quadrature phase properties of directional couplers. Another means uses power sharing between single-mode beams. In using these techniques, transmitted power is fed principally into the beam-forming network forming the beam or footprint for West Canada and, at the same time, a small portion of the power is fed into the adjacent beam-forming network forming the beam for East Canada or into restricted parts of said beam-forming network. The restricted parts are usually those horns which are associated with the areas where the East and West Canada footprints overlap. If it subsequently becomes necessary that the transmitter power be transferred from the West Canada footprint to the East Canada footprint without loss of coverage in the overlap region, the overlap horns must also be connected into the East Canada array. This is usually accomplished by designing the overlap horns into a separate dual-mode subarray and beam-former that is fed by two ports, one of said ports being connected into the West Canada beam-former and the other being connected into the East Canada beam-former. In prior art beam-forming networks, where power is shared between single-mode beams, there is a power loss of approximately ten percent when the beam-forming network is in an East Canada or West Canada configuration. This power loss occurs at individual ground stations and is extremely expensive. A ten percent power loss can result in additional costs of one million dollars per channel at a ground station. When dual-mode prior art beam-formers are used for the overlap region subarray, phase weightings can no longer be uniform and a loss of antenna gain and beam-shaping control are therefore encountered.

SUMMARY OF THE INVENTION

It is an object of the present invention to provide an improved reconfigurable beam-forming network in which the phases of a first region array weightings, including those of the shared overlap subarray, are equal, and after reconfiguration by means of a single switch, the phases of a second region array weightings, including those of the shared overlap subarray are again equal, without significant restriction on the amplitude weighting and without significant power sharing between beams.

A reconfigurable beam-forming network for use with a transmitter has:

(a) in-phase power-dividing means and phase adjusting means;

(b) an n to m n-mode power-dividing network consisting of an assembly of directional couplers, said network having n input ports and m output ports, where m and n are positive integers, n is greater than 1 and m is greater than n;

(c) a feed horn array;

(d) m region power-dividing networks, each network consisting of an assembly of directional couplers and compensating phase shifters, each network having one input port which is connected to one output port from said power-dividing network, each network having $N_i$ output ports, where $N_i$ is equal to the number of feed horns desired in an i region, where i is any integer from 1 to m;

(e) each region being geographically adjacent to or overlapping with at least one other region.

The in-phase power-dividing means is suitably connected to the n input ports of the n-mode power-dividing network, one output port from said n-mode power-dividing network being connected to one input port of each region. The phase adjusting means has at least m distinct positions so that at least m distinct beams with overlap can be formed. The power being fed to the feed horns of any one of the m regions has the same phase.

Preferably, where m equals 3, the in-phase power-dividing means and phase shifting means is a Magic T suitably connected to an R-switch having means of adjusting phase.

Also preferably, where m equals 3, the in-phase power-dividing means is a Magic T and the phase shifting means is a variable phase shifter.

BRIEF DESCRIPTION OF THE DRAWINGS

The present invention will be better understood by reviewing the following drawings in which.

DESCRIPTION OF A PREFERRED EMBODIMENT

Figure 1:
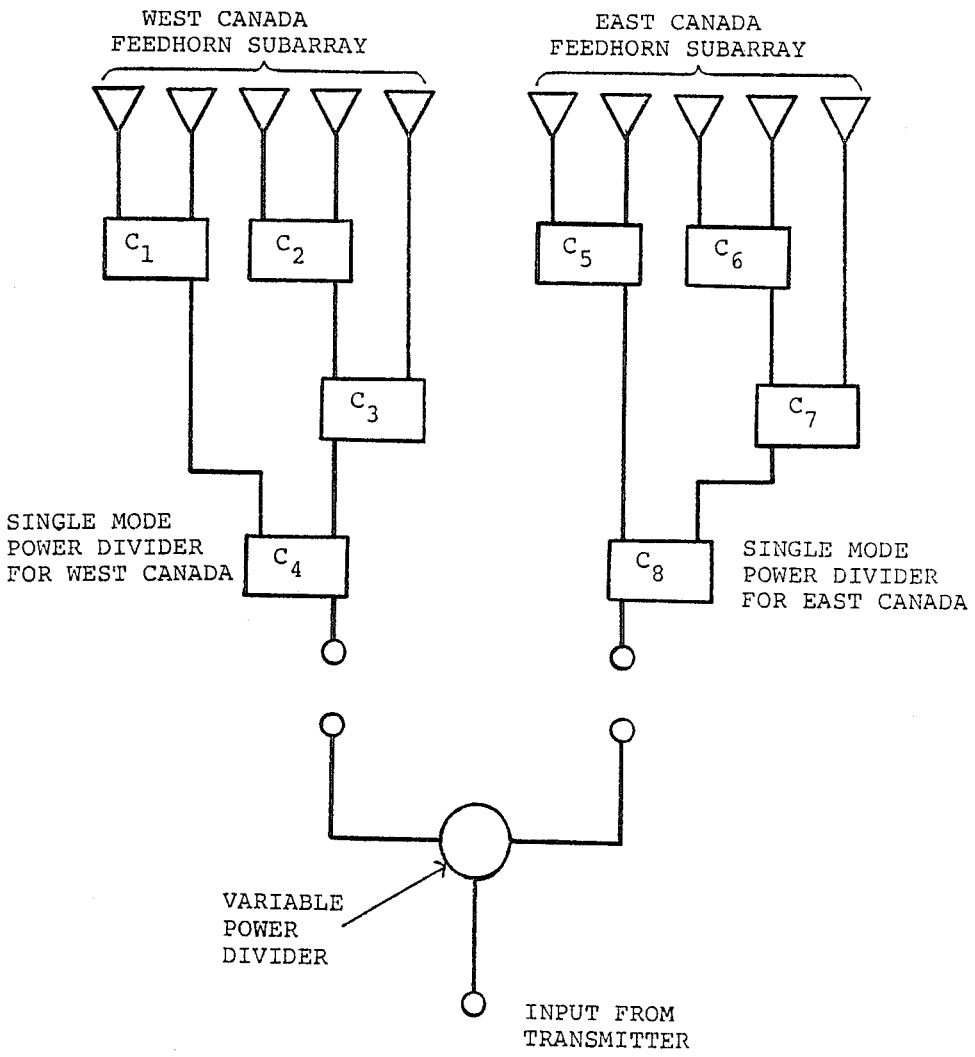
FIG. 1 is a block diagram of a typical reconfigurable beam-former of the prior art, where power is shared between single mode beams.

Referring to FIG. 1 in greater detail, a prior art reconfigurable beam-forming network (henceforth RBFN) has two single-mode power-dividing networks, having a plurality of power-dividers $C_1$, $C_2$, $C_3$, $C_4$, $C_5$, $C_6$, $C_7$ and $C_8$, associated with a variable power divider. Each of the two power-dividing networks is associated with one of two feed horn subarrays, one for a first region and one for a second region that is geographically adjacent to the first region. For example, the first region could be West Canada and the second region could be East Canada.

Figure 2:
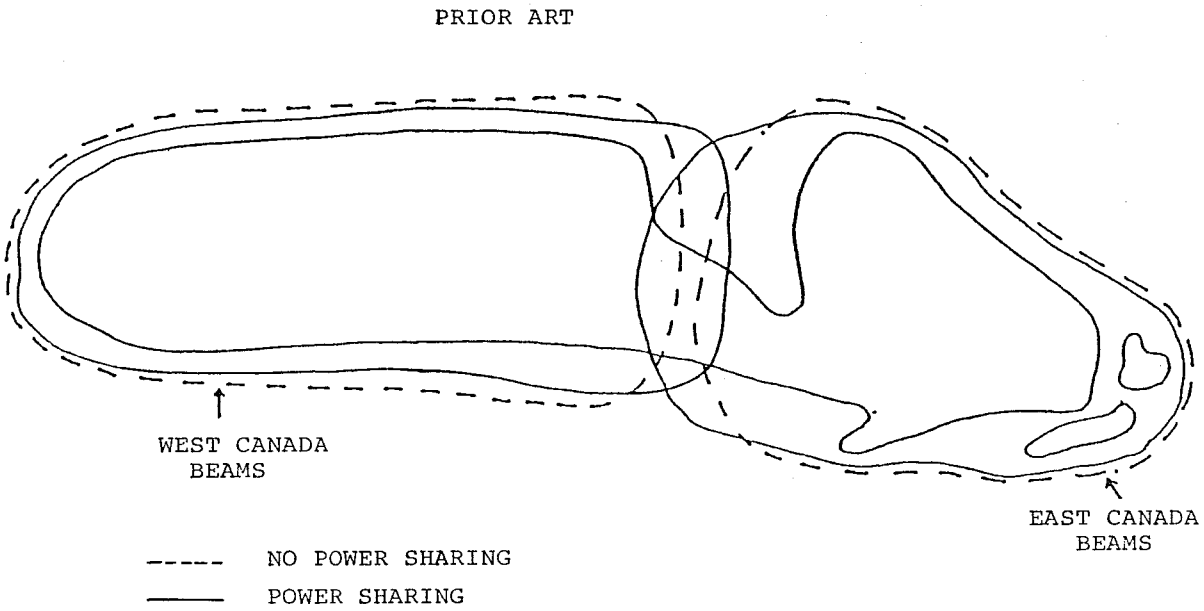
PRIOR ART FIGURE 2
FIG. 2 shows the coverage achievable with the prior art beam-former of FIG. 1.

Without the special arrangements that are known in the prior art, each of the two power-dividing networks would provide a single half-Canada beam as illustrated by the dashed lines in FIG. 2, one for West Canada and one for East Canada. This arrangement would be unsatisfactory in the area where the two beams touch or overlap in that insufficient flux would be available in that area. However, by using the variable power divider shown in FIG. 1, if the first region beam is to be formed, the variable power divider can be switched into Position 1 and most of the transmitter power (approximately ninety percent) is switched to the first region or West Canada subarray and the balance of the power (approximately ten percent) is fed to the second region or East Canada subarray. This arrangement effectively weights the combined footprint to the east and thereby covers the overlap region. To generate the East Canada beam, the variable power divider is switched to Position 2 and most (approximately ninety percent) of the transmitter power is switched to the second region or East Canada subarray, with the balance (approximately ten percent) being fed to the first region or West Canada subarray. In this manner, the overlap region is adequately covered as illustrated by the solid line shown in FIG. 2. To generate a beam covering the whole of Canada, the variable power divider is set to Position 3 and roughly equal amounts of power are delivered to the two half-Canada feed horn arrays. The disadvantage of this arrangement is that, when the variable power divider is in Position 1 or Position 2, the ground stations in the West Canada subarray or the East Canada subarray respectively receive approximately ten percent less power than the power being emitted from the transmitter. This power loss can be extremely costly.

The distribution of power between Ports A and B of the two single-mode power-dividing networks shown in FIG. 1 are illustrated in Table 1:

| VPD Position | Beam | Power Division (%) Port A | Port B |
|---|---|---|---|
| 1 | West Canada | 90 | 10 |
| 2 | East Canada | 10 | 90 |
| 3 | All Canada | 50 | 50 |

Figure 3:
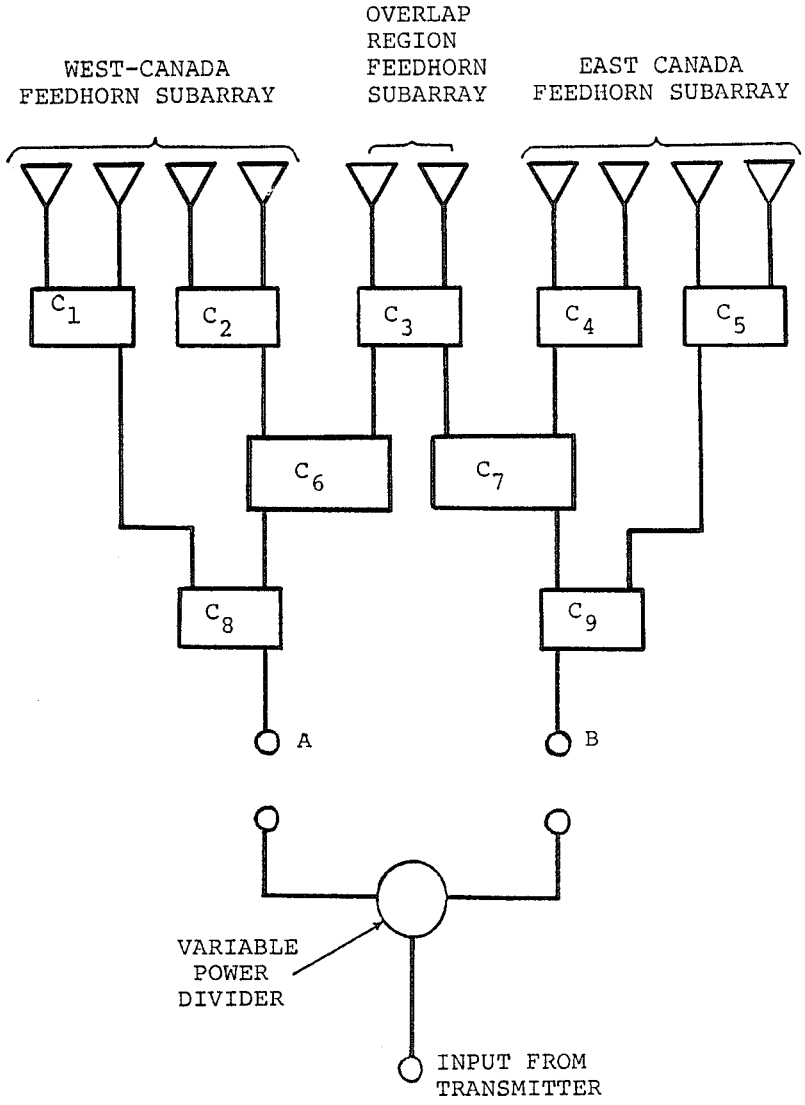
FIG. 3 is a block diagram of a reconfigurable beam-former of the prior art having a dual-mode subarray.
Figure 4:
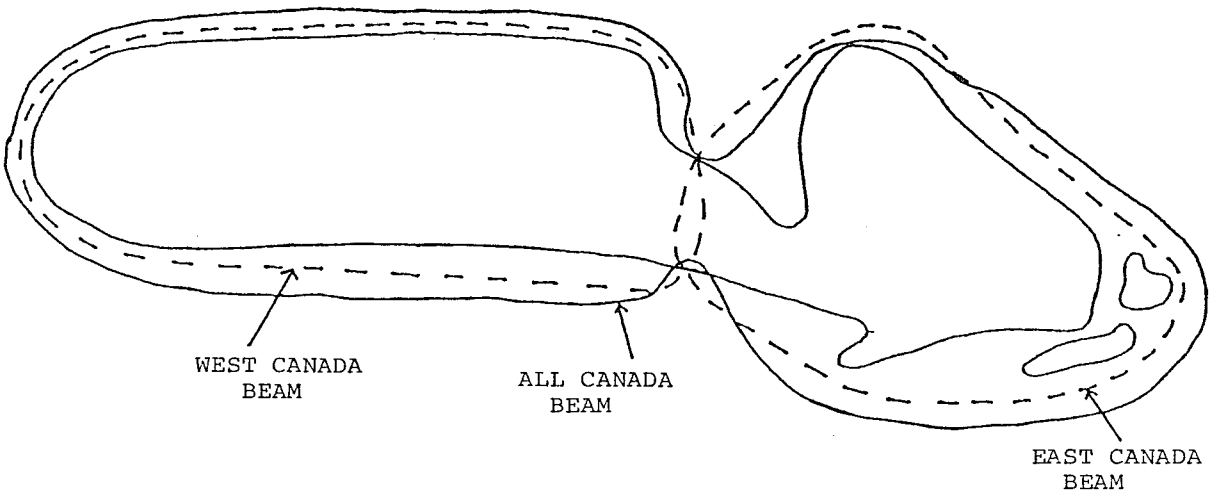
PRIOR ART FIGURE 4
FIG. 4 shows the coverage achievable with the prior art beam-former of FIG. 3.

In FIG. 3, there is shown a modification of the prior art RBFN shown in FIG. 1 in that there is a special overlap region subarray consisting of at least two feed horns and an associated dual-mode power-dividing network. One type of dual-mode power-dividing network that is suitable is a 3 dB, ninety degree hybrid directional coupler, with two input ports and two output ports. The two output ports are connected to the two feed horns associated with the overlap region. One input port is connected to a first region or West Canada power-dividing network and the other input is connected to a second region or East Canada power-dividing network. The three power-dividing networks have power dividers $C_1$, $C_2$, $C_3$, $C_4$, $C_5$, $C_6$, $C_7$, $C_8$, $C_9$. When the variable power divider is in Position 1, all power is transferred into the first region or West Canada beam-forming network, with a small portion flowing through the dual-mode power divider to provide coverage of the overlap region. By switching the variable power divider to Position 2, all power is transferred into the second region or East Canada beam-forming network, with a small portion flowing through the dual-mode power divider to provide coverage of the overlap region. These West Canada and East Canada beams are shown by the dashed lines in FIG. 4. To form a beam covering the whole of Canada, represented by the solid line shown in FIG. 4, the variable power divider is placed in Position 3 an power is fed in approximately equal parts, with appropriate phasing, half to the West Canada network and half to the East Canada network. When the variable power divider is in Position 1 or Position 2, this arrangement can cause poor coverage over the overlap region due to destructive interference of the two feeding paths into the overlap subarray. The quadrature phase coupler used in the overlap subarray causes the phase of the two feeding paths to be ninety degrees apart causing a power loss as there is no voltage addition between the two paths.

The power division for the prior art RBFN shown in FIG. 3 is set out in Table 2:

| VPD Position | Beam | Power Division (%) Port A | Port B |
|---|---|---|---|
| 1 | West Canada | 100 | 0 |
| 2 | East Canada | 0 | 100 |
| 3 | All Canada | 50 | 50 |

Figure 5:
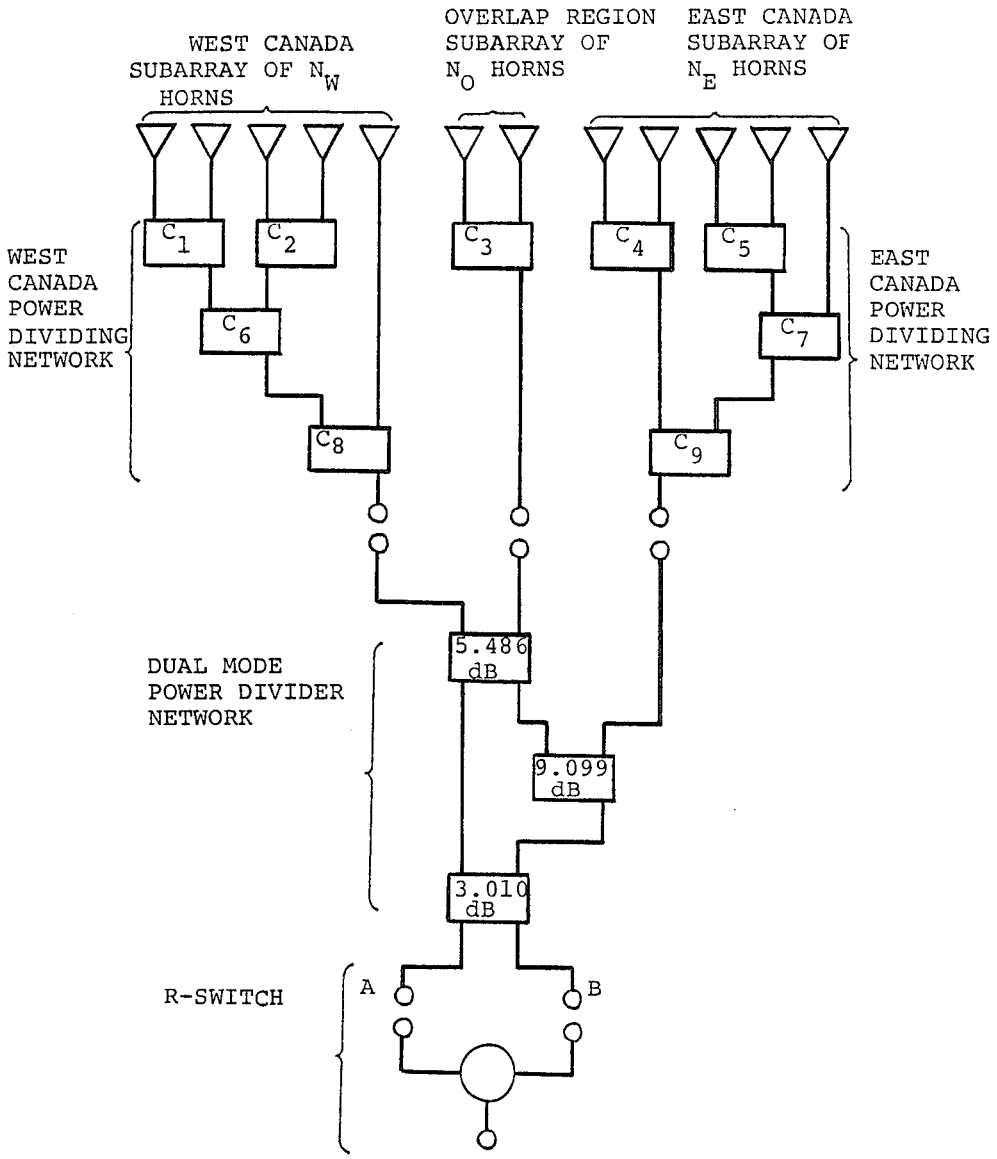
FIG. 5 is a block diagram of a reconfigurable beam-forming network in accordance with the present invention.

In FIG. 5, there is shown an RBFN in accordance with the present invention. The RBFN has a waveguide R-switch and associated output connecting waveguide runs that lead to a dual-mode power-dividing network. The dual-mode power-dividing network consists of an assembly of directional couplers and has two input ports and three output ports. By an appropriate choice of coupling values, one appropriate set of values being shown in FIG. 5, it is possible to vary the amounts of power delivered to each of the three output ports from each of the two input ports. The three output ports are connected to three subarray power-dividing networks. A first region power-dividing network consists of an assemblage of directional couplers and compensating phase shifters. This network has one input port and $N_W$ output ports. Each of the $N_W$ output ports in connected to a feed horn of the first region feed horn array. By way of Q example, the first region could be the western half of Canada. The first region power-dividing network contains power dividers $C_1$, $C_2$, $C_6$ and $C_8$.

A second region power-dividing network also consists of an assemblage of directional couplers and compensating phase shifters. This second region is geographically adjacent to said first region and has one input and $N_E$ output ports. Each of the $N_E$ output ports is connected to a feed horn of the second region feed horn array. The second region is geographically adjacent to the first region and, by way of example, can be the eastern half of Canada. The second power-dividing network has power dividers $C_4$, $C_5$, $C_7$ and $C_9$.

An overlap region power-dividing network consists of an assemblage of directional couplers and compensating phase shifters and has one input port and $N_O$ output ports. Each of the $N_O$ output ports is connected to a feed horn in the overlap region feed horn array. The feed horn array consists of $N_W+N_E+N_O$ feed horns and can be any reasonable number of feed horns, depending on the area to be covered. The overlap region has one power divider $C_3$. The RBFN in accordance with the present invention can provide two overlapping half-beams when fed by appropriately phased inputs at Ports A and B shown in FIG. 5. In addition, a whole coverage beam can be generated by appropriately phased inputs at Ports A and B. The feeding and phasing requirements are summarized in Table 3:

| | Port A | | Port B | |
|---|---|---|---|---|
| | Power | Phase | Power | Phase |
| West-Canada Beam | 50% | 0° | 50% | 100° |
| East-Canada Beam | 50% | 0° | 50% | −55° |
| All Canada Beam | 100% | 0° | 0 | — |

In the RBFN shown in FIG. 5, when the RBFN is in the All Canada position, all of the power enters Port A and no power enters Port B. The RBFN would function in a similar manner in this position if all of the power entered Port B and none of the power entered Port A, but the output phases of the signals from the three output ports would be changed in sign.

Figure 6:
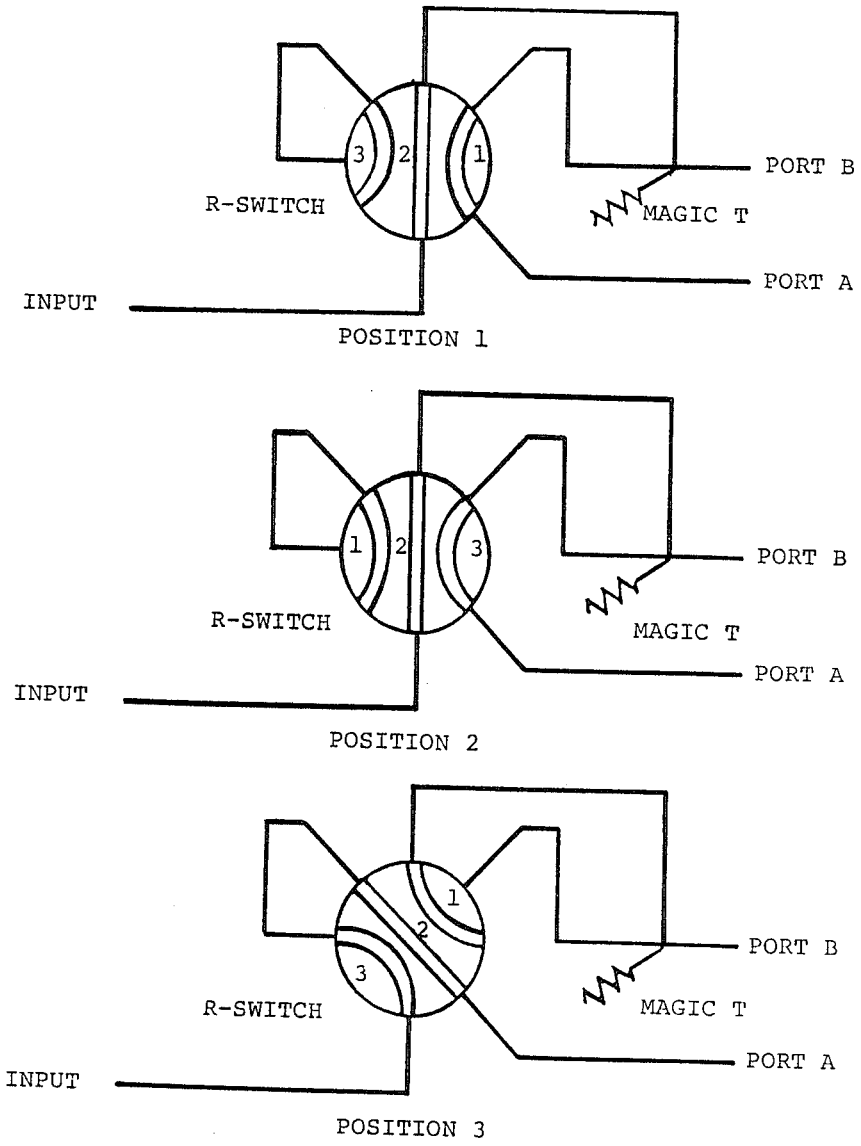
FIG. 6 is a schematic drawing of an R-switch and Magic T with the R-switch shown in Position 1, Position 2 and Position 3.

In FIG. 6, there is shown an enlarged version of the R-switch in three positions. The circuit contains, in addition to the R-switch, a Magic T, which is used as an H-Plane splitter. The R-switch has three waveguide paths, a central path and two outer paths, the two outer paths containing phasing elements. The central path is path 2 and the outer paths are paths 1, 3. In Position 1 shown in FIG. 6, input power is fed into the R-switch path 2 as indicated with the output from path 2 connecting to the input of the Magic T. The Magic T divides the power into two equal in-phase parts, one part being directed through R-switch path 1 to Port A and the other part being directed to Port B. R-switch path 1 contains phasing elements e.g. a change in waveguide dimensions) designed to realize the phase requirements shown in Table 3 for the West-Canada Beam.

In Position 2 shown in FIG. 6, the input power is led through R-switch path 2. Then, after division by the Magic T into two equal in-phase parts, one part is fed directly to Port B and the other part is directed through R-switch path 3 to Port A. Path 3 contains appropriate phasing elements (e.g. a change in waveguide dimensions) designed to realize the phase requirements of Table 3 for the East-Canada Beam.

In Position 3, as shown in FIG. 6, the input power is all directed to Port A to achieve the requirements of Table 3 for the All Canada Beam. The RBFN would operate in a similar manner in this position if all of the input power was directed to Port B rather than Port A, although the output phases of the signals from the three output ports would be changed in sign.

In FIGS. 5 and 6, there is shown a reconfigurable beam-forming network for use with a transmitter having:

(a) a waveguide R-switch with means of adjusting phase;
(b) a dual-mode power-dividing network consisting of an assembly of directional couplers, said network having two input ports and three output ports;
(c) a feed horn array;
(d) a first region power-dividing network consisting of an assembly of directional couplers and compensating phase shifters, said first network having one input port and $N_W$ output ports, where $N_W$ is equal to the number of feed horns desired in said first region;
(e) a second region power-dividing network consisting of an assembly of directional couplers and compensating phase shifters, said second network having one input port and $N_E$ output ports, where $N_E$ is equal to the desired number of feed horns in said second region, said second region being geographically adjacent to said first region;
(f) an overlap region power-dividing network consisting of an assembly of directional couplers and compensating phase shifters, said network having one input port and $N_O$ output ports, where $N_O$ is equal to the desired number of feed horns in said overlap region;
(g) the feed horn array having $N_W$, $N_O$ and $N_E$ feed horns connected to the first region network, the overlap region network and the second region network respectively.

The R-switch is suitably connected to the two input ports of the dual-mode network, one output port from said dual-mode network being connected to an input port for said first region network. A second output from the dual-mode network is connected to an input for said second region network and a third output from said dual-mode network is connected to an input for said overlap network. The R-switch has three distinct waveguide paths and is operable in three distinct positions so that:

(i) in a first position, power entering said R-switch is divided between the two input ports of the dual-mode network on substantially a fifty-fifty basis, the power on a first input port being out of phase on a positive basis with the power on the other input port of the dual-mode network;
(ii) in a second position of said R-switch, power entering said R-switch is divided on substantially a fifty-fifty basis between said input ports of said dual-mode network, with power on a first input port being out of phase with power on a second input port of said dual-mode network on a negative basis;

(iii) in a third position, substantially all of the power entering said R-switch is passed into the first input port of the dual-mode network.

The power being fed to the feed horns of any one of the regions has the same phase.

Figure 7A:
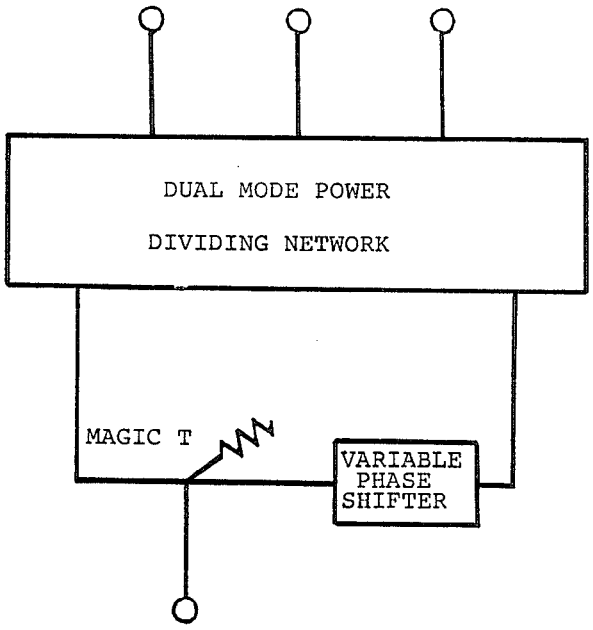
FIG. 7A is a partial block diagram of a reconfigurable beam-forming network showing the use of a variable phase shifter together with a Magic T.

An alternative design for achieving similar reconfiguration as that shown in FIGS. 5 and 6 is shown in FIG. 7A where a variable phase shifter is used in conjunction with a Magic T to vary the phase difference between the outputs of the Magic T before feeding equal amplitude signals to the two input ports of the dual-mode power-divider. In this way, it is possible to provide three equally-phased outputs. Only part of the RBFN is shown in FIG. 7A. The three outputs from the dual-mode power-divider are connected to the three subarrays (not shown in FIG. 7A) in the same manner as shown in FIG. 5. The dual-mode power-divider is the same as that shown in FIG. 5. The Magic T and variable phase shifter replace the R-switch and Magic T shown in FIG. 5. This system can be made to operate in the same way as the RBFN of FIG. 5.

The variable phase shifter shown in FIG. 7A is operable in three distinct positions so that:

(i) in a first position, the power incident on a first input port of said dual-mode network being out of phase on a positive basis with the power incident on the other input port of the dual-mode network;

(ii) in a second position, the power incident on a first input port of said dual-mode network being out of phase on a negative basis, with the power incident on the other input port of the dual-mode network;

(iii) in a third position, the power incident on a first input port of said dual-mode network being in-phase with the power incident on the other input port of the dual-mode network.

The power being fed to the feed horns of all of the regions having the same phase.

Figure 7B:
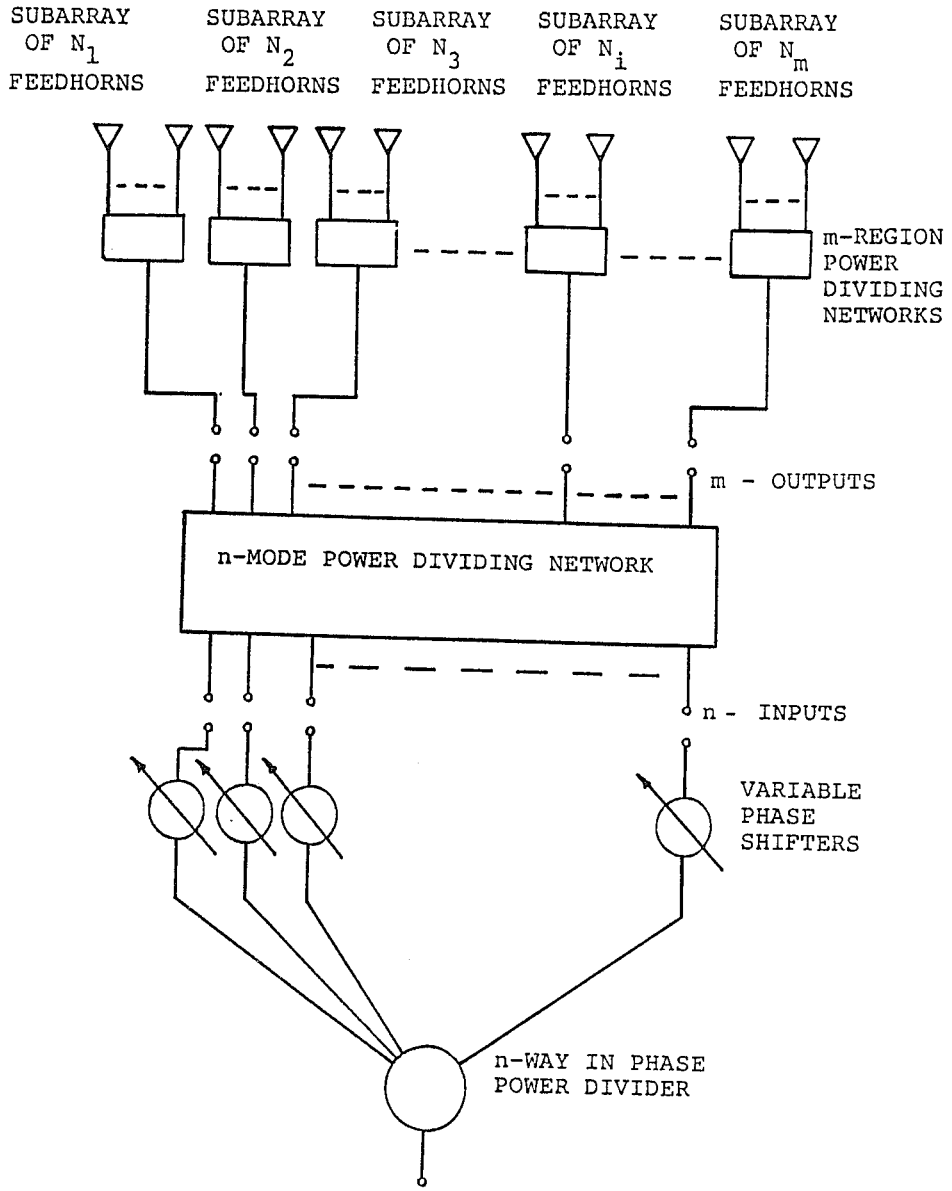
FIG. 7B is a block diagram of a reconfigurable beam-forming network having a power-divider with n input ports and m output ports, where m and n are integers and $m-n=1$.

In FIG. 7B, there is shown a further variation in the RBFN of the present invention. The RBFN has an n-way in-phase power-divider and n variable phase shifters, one for each input port of an n-mode power-dividing network that replaces the dual-mode power-dividing network shown in FIG. 5. The power-dividing network has n input ports and m output ports where $m-n=1$. Each output port is connected to a region power-dividing network, there being m regions. Each region contains a subarray of feed horns so that there are m regions of feed horns $N_1$, $N_2$, $N_3$ . . . $N_m$. The n-way power-divider has at least m distinct positions so that at least m distinct beams with overlap can be formed. The power being fed to the feed horns of the m regions has the same phase. When m equals 3, the RBFNs shown in FIGS. 5 and 7 can be formed.

By simple network analysis procedures, it can be calculated that the amplitude and phase excitations which result at the feed horns using a total of 17 feed horns with the coupling values given in FIG. 5 will be that shown in Table 4 if the feed horns are disposed in front of a two meter reflector located in geostationary orbit at 120° W longitude. It can be seen from Table 4 that when the R-switch is in a West Canada position, the total power in feed horns 9 to 17 inclusive is 0.99312. Thus, the power loss in feed horns 1 to 8 inclusive is only 0.00688 or 0.7%. Similarly, when the R-switch is in the East Canada position, it can be seen that the total power in feed horns 1 to 11, inclusive, being the East Canada feed horns and the overlap feed horns, is 0.9942. The power in feed horns 12 to 17 inclusive, is only 0.0058. Therefore, the power loss is only 0.6%. This compares favourably with the power loss of some prior art RBFNs of approximately ten percent.

Also from Table 4, it should be noted that in the West Canada position the phase of the power at the East Canada feed horns (i.e. 1 to 8) is one hundred and eighty degrees and the phase of the power at the West Canada and overlap feed horns (i.e. 9 to 17) is zero degrees. In the East Canada position, the phase of the power at all feed horns is zero degrees. In the All Canada position, the phase of the power at the East Canada feed horns (i.e. 1 to 8) is −60.81°, the phase of the power at the overlap feed horns (i.e. 9 to 11) is zero degrees and the phase of the power at the West Canada feed horns (i.e. 12 to 17) is 41.62°. In all positions, the phase of the power at each of the feed horns of any one region is the same.

Figure 8:
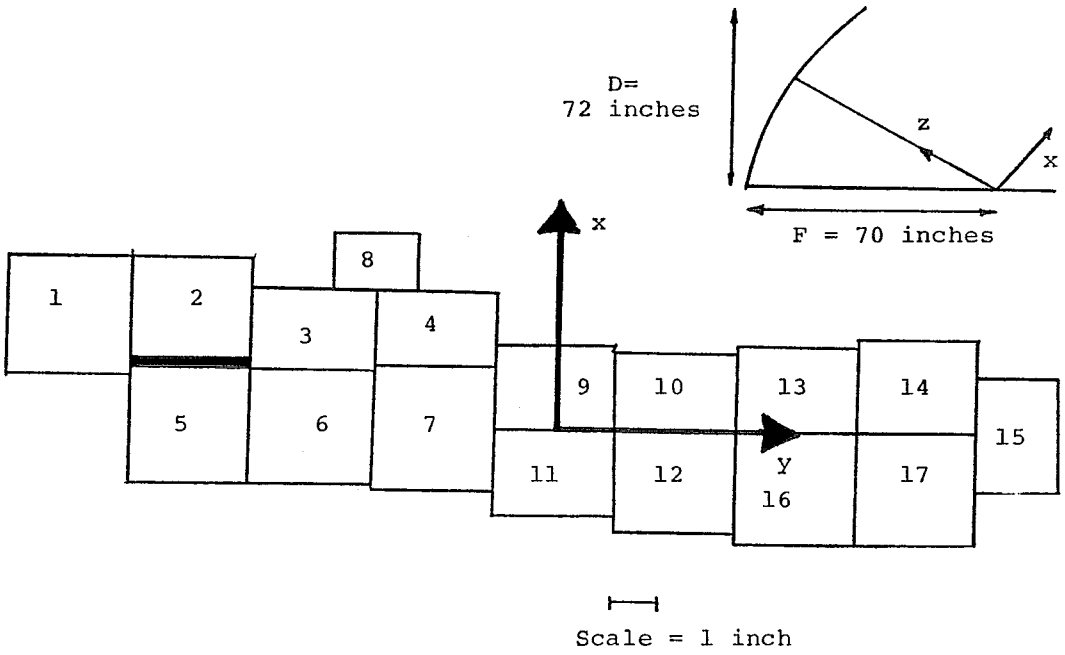
FIG. 8 illustrates the dispositions of feed horns in a typical example of a shaped beam antenna with the reconfigurable beam-former shown in FIG. 5.
Figure 9:
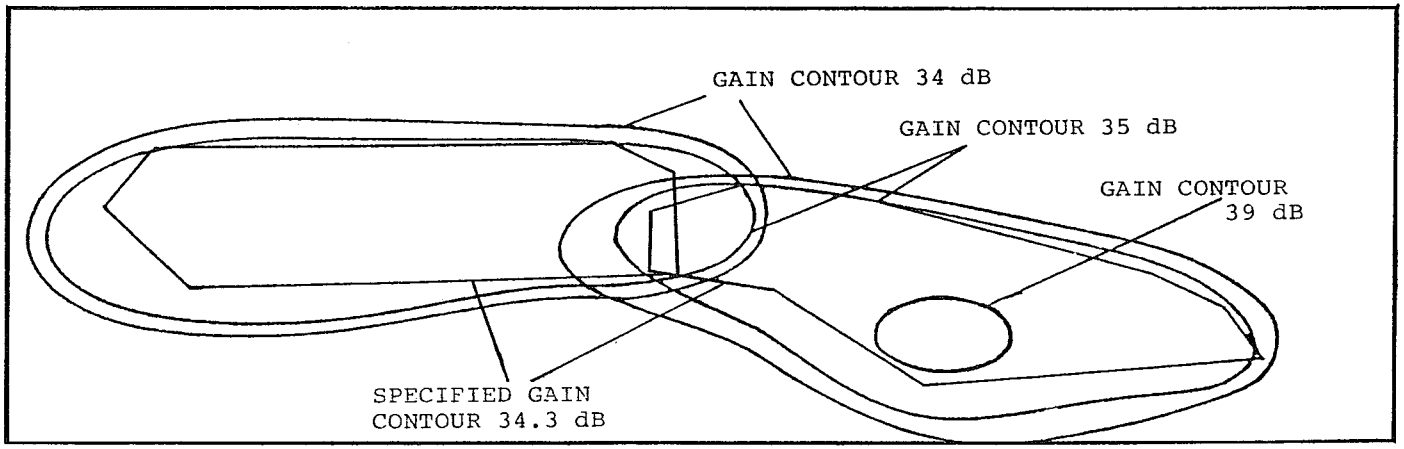
FIG. 9 illustrates the coverage achievable with the reconfigurable beam-former shown in FIG. 5 and the R-switch in Position 1 or Position 2.
Figure 10:
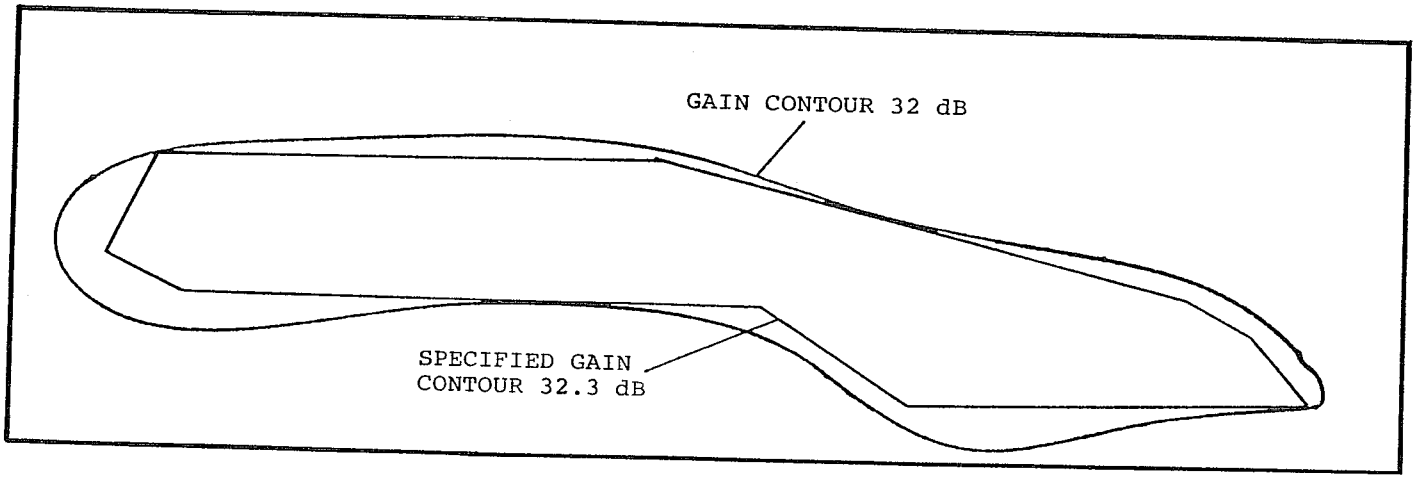
FIG. 10 illustrates the coverage achievable with the reconfigurable beam-former shown in FIG. 5 and the R-switch in Position 3.

The RBFN designed to produce the results shown in Table 4 with the feed horn arrangement shown in FIG. 8 will produce the coverage shown in FIG. 9 when the R-switch is in Positions 1 and 2. The coverage when the R-switch is in Position 3 is that shown in FIG. 10.

TABLE 4

| | ALL CANADA | | EAST CANADA | | WEST CANADA | |
|---|---|---|---|---|---|---|
| HORN | POWER | PHASE | POWER | PHASE | POWER | PHASE |
| 1 | 0.030 | −60.81 | 0.0546 | 0.0 | 0.0005 | 180.0 |
| 2 | 0.0367 | −60.81 | 0.0668 | 0.0 | 0.0006 | 180.0 |
| 3 | 0.1100 | −60.81 | 0.2001 | 0.0 | 0.0017 | 180.0 |
| 4 | 0.0850 | −60.81 | 0.1546 | 0.0 | 0.0013 | 180.0 |
| 5 | 0.0380 | −60.81 | 0.0691 | 0.0 | 0.0006 | 180.0 |
| 6 | 0.0488 | −60.81 | 0.0888 | 0.0 | 0.0007 | 180.0 |
| 7 | 0.0700 | −60.81 | 0.1273 | 0.0 | 0.0011 | 180.0 |
| 8 | 0.0200 | −60.81 | 0.0364 | 0.0 | 0.0003 | 180.0 |
| 9 | 0.0638 | 0.0 | 0.0676 | 0.0 | 0.08730 | 0.0 |
| 10 | 0.0622 | 0.0 | 0.0659 | 0.0 | 0.08510 | 0.0 |
| 11 | 0.0595 | 0.0 | 0.0630 | 0.0 | 0.08140 | 0.0 |
| 12 | 0.0650 | 41.62 | 0.0010 | 0.0 | 0.1278 | 0.0 |
| 13 | 0.0889 | 41.62 | 0.0014 | 0.0 | 0.1748 | 0.0 |
| 14 | 0.0800 | 41.62 | 0.0013 | 0.0 | 0.1573 | 0.0 |
| 15 | 0.0318 | 41.62 | 0.0005 | 0.0 | 0.0625 | 0.0 |
| 16 | 0.0618 | 41.62 | 0.0010 | 0.0 | 0.1215 | 0.0 |
| 17 | 0.0485 | 41.60 | 0.0008 | 0.0 | 0.0954 | 0.0 |

While the examples used in the present application are East Canada, West Canada and All Canada positions, these are examples only and the RBFN in accordance with the present invention can be used in any region or regions to divide power from a transmitter. It is believed that the RBFN of the present invention has a cost advantage over prior art RBFNs, due to the large power saving when the R-switch is in Positions 1 and 2 of approximately one million dollars per channel.

What we claim as our invention is:

1. A reconfigurable beam-forming network for use with a transmitter comprising:

(a) in-phase power-dividing means and phase adjusting means;

(b) an n to m n-mode power-dividing network consisting of an assembly of directional couplers, said network having n input ports and m output ports, where m and n are positive integers, n is greater than 1 and m is greater than n;

(c) a feed horn array;

(d) m region power-dividing networks, each network consisting of an assembly of directional couplers and compensating phase shifters, each network having one input port which is connected to one output port from said power-dividing network, each network having $N_i$ output ports, where $N_i$ is equal to the number of feed horns desired in an i region, where i is any integer from 1 to m;

(e) each region being geographically adjacent or overlapping with at least one other region;

said in-phase power-dividing means being suitably connected to the n input ports of the n-mode power-dividing network, one output port from said n-mode power-dividing network being connected to one input port of each region, said phase adjusting means having at least m distinct positions so that at least m distinct beams with overlap can be formed, the power being fed to the feed horns of any one of the m regions having the same phase.

2. A reconfigurable beam-forming network as claimed in claim 1 wherein the power-dividing means is an n-way in-phase power divider and the phase adjusting means is a phase shifter interconnected between each of the n input ports of the n-mode power-dividing network and the n-way power divider.

3. A reconfigurable beam-forming network as claimed in claim 2 wherein m is equal to 3.

4. A reconfigurable beam-forming network as claimed in claim 3 wherein the in-phase power-dividing means and phase shifting means is a Magic T suitably connected to an R-switch having means of adjusting phase.

5. A reconfigurable beam-forming network as claimed in claim 4 wherein the means of adjusting phase are phasing elements in the waveguide paths of the R-switch.

6. A reconfigurable beam-forming network as claimed in claim 3 wherein the in-phase power-dividing means is a Magic T and the phase shifting means is a variable phase shifter.

7. A reconfigurable beam-forming network for use with a transmitter comprising:

(a) a waveguide R-switch with means of adjusting phase;

(b) a dual-mode power-dividing network consisting of an assembly of directional couplers, said network having two input ports and three output ports;

(c) a feed horn array;

(d) a first region power-dividing network consisting of an assembly of directional couplers and compensating phase shifters, said first network having one input port and $N_W$ output ports, where $N_W$ is equal to the number of feed horns desired in said first region;

(e) a second region power-dividing network consisting of an assembly of directional couplers and compensating phase shifters, said second network having one input port and $N_E$ output ports, where $N_E$ is equal to the desired number of feed horns in said second region, said second region being geographically adjacent to said first region;

(f) an overlap region power-dividing network consisting of an assembly of directional couplers and compensating phase shifters, said network having one input port and $N_O$ output ports, where $N_O$ is equal to the desired number of feed horns in said overlap region;

(g) the feed horn array having $N_W$, $N_O$ and $N_E$ feed horns connected to the first region network, the overlap region network and the second region network respectively, said R-switch being suitably connected to the two input ports of the dual-mode network, one output port from said dual-mode network being connected to an input port for said first region network, a second output from the dual-mode network being connected to an input for said second region network and a third output from said dual-mode network being connected to an input for said overlap network, said R-switch having three waveguide paths and being operable in three distinct positions so that:

(i) in a first position, power entering said R-switch is divided between the two input ports of the dual-mode network on substantially a fifty-fifty basis, the power on a first input port being out of phase on a positive basis with the power on the other input port of the dual-mode network;

(ii) in a second position of said R-switch, power entering said R-switch is divided on substantially a fifty-fifty basis between said input ports of said dual-mode network, with power on a first input port being out of phase with power on a second input port of said dual-mode network on a negative basis;

(iii) in a third position, substantially all of the power entering said R-switch is passed into the first input port of the dual-mode network;

the power being fed to the feed horns of any one of the regions having the same phase.

8. A reconfigurable beam-forming network as claimed in claim 7 wherein the R-switch is interconnected with a Magic T and the means of adjusting phase are phasing elements located within the R-switch.

9. A reconfigurable beam-forming network as claimed in claim 8 wherein the R-switch has three waveguide paths, a central path and two outer paths, the two outer paths containing phasing elements.

10. A reconfigurable beam-forming network as claimed in claim 9 wherein the phasing elements in the waveguide paths are a change in dimensions of said paths.

11. A reconfigurable beam-forming network as claimed in claim 10 wherein a Magic T is connected to the R-switch so that in the first and second positions, power from the central waveguide path of the R-switch passes through the Magic T where it is divided into two equal in-phase parts.

12. A reconfigurable beam-forming network as claimed in claim 11 wherein $N_W$ is equal to 6, $N_O$ is equal to 3 and $N_E$ is equal to 8.

13. A reconfigurable beam-forming network for use with a transmitter comprising:

(a) a variable phase shifter and a Magic T;

(b) a dual-mode power-dividing network consisting of an assembly of directional couplers, said network having two input ports and three output ports;

(c) a feed horn array;

(d) a first region power-dividing network consisting of an assembly of directional couplers and compensating phase shifters, said first network having one input port and $N_W$ output ports, where $N_W$ is equal to the number of feed horns desired in said first region;

(e) a second region power-dividing network consisting of an assembly of directional couplers and compensating phase shifters, said second network having one input port and $N_E$ output ports, where $N_E$ is equal to the desired number of feed horns in said second region, said second region being geographically adjacent to said first region;

(f) an overlap region power-dividing network consisting of an assembly of directional couplers and compensating phase shifters, said network having one input port and $N_O$ output ports, where $N_O$ is equal to the desired number of feed horns in said overlap region;

(g) the feed horn array having $N_W$, $N_O$ and $N_E$ feed horns connected to the first region network, the overlap region network and the second region network respectively, said variable phase shifter and Magic T being suitably interconnected and connected to the two input ports of the dual-mode network yielding a power split on a fifty-fifty basis, one output port from said dual-mode network being connected to an input port for said first region network, a second output from the dual-mode network being connected to an input for said second region network and a third output from said dual-mode network being connected to an input for said overlap network, said variable phase shifter being operable in three distinct positions so that:

(i) in a first position, the power incident on a first input port of said dual-mode network being out of phase on a positive basis with the power incident on the other input port of the dual-mode network;

(ii) in a second position, the power incident on a first input port of said dual-mode network being out of phase on a negative basis, with the power incident on the other input port of the dual-mode network;

(iii) in a third position, the power incident on a first input port of said dual-mode network being in-phase with the power incident on the other input port of the dual-mode network;

the power being fed to the feed horns for all of the three regions having the same phase.

14. A reconfigurable beam-forming network as claimed in claim 13 wherein:

(i) in the first position, power entering said Magic T is divided between the two input ports of the dual-mode network on substantially a fifty-fifty basis;

(ii) in the second position, the power entering said Magic T is divided between the two input ports of the dual-mode network on substantially a fifty-fifty basis;

(iii) in the third position, substantially all of the power entering said Magic T and variable phase shifters pass into the first input port of the dual-mode network.

* * * * *